United States Patent [19]

Meyers et al.

[11] Patent Number: 4,654,893

[45] Date of Patent: Apr. 7, 1987

[54] SHOULDER PAD BRACE

[75] Inventors: Andrew Meyers, West Hempstead; Jeffrey Minkoff, New York; David Langevin, North Port, all of N.Y.

[73] Assignee: Sports Protective Orthotics Ltd., New York, N.Y.

[21] Appl. No.: 779,103

[22] Filed: Sep. 23, 1985

[51] Int. Cl.[4] ..... A41D 13/00

[52] U.S. Cl. ..... 2/2

[58] Field of Search ..... 2/2

[56] References Cited

U.S. PATENT DOCUMENTS

| | | | |
|---|---|---|---|
| 2,071,827 | 2/1937 | Glahe | 2/2 |
| 2,545,039 | 3/1951 | Mitchel | 2/2 |
| 3,158,871 | 12/1964 | Morgan | 2/2 |
| 3,509,579 | 5/1970 | Morgan | 2/2 |
| 4,158,242 | 6/1979 | Mitchell | 2/2 |
| 4,320,537 | 3/1982 | Mitchell | 2/2 |
| 4,322,859 | 4/1982 | Mitchell | 2/2 |
| 4,435,851 | 3/1984 | Mitchell et al. | 2/2 |
| 4,453,271 | 6/1984 | Donzis | 2/2 |
| 4,547,905 | 10/1985 | La Porta | 2/2 |

*Primary Examiner*—Louis K. Rimrodt

*Attorney, Agent, or Firm*—Sixbey, Friedman & Leedom

[57] ABSTRACT

An improved shoulder brace having a pair of shock absorbing saddle assemblies and cups for protecting the acromioclavicular and glenohumeral joints is disclosed herein. Each saddle assembly includes a resilient, ring-shaped member for seating over and conforming to its respective acromioclavicular joint. The cups overlie each saddle assembly, and form a shock absorbing air space over each saddle assembly. Additionally, each cup includes anterior and posterior portions for protecting the front of the glenohumeral joint, and the back of the scapula respectively. Finally, each saddle assembly includes an upper arm pad which is attached to its respective saddle by means of an omni-directional hinge joint. The improved shoulder brace provides lightweight and effective protection for the shoulder joints without impairing the agility of the athlete.

27 Claims, 5 Drawing Figures

SHOULDER PAD BRACE

TECHNICAL FIELD

This invention generally relates to a protective shoulder pad brace for use in sports events, and in particular to a shoulder pad which offers improved protection to the acromioclavicular and glenohumeral joints.

BACKGROUND ART

Shoulder pads for protecting the shoulder regions in contact sports such as football and hockey are well known in the art. Generally speaking, such shoulder pads include a harness arrangement which circumscribes the chest region for mounting a rounded shoulder pad assembly over each of the shoulders of the wearer. In many of these prior art shoulder pads, the padding assembly is formed from a plurality of rounded members which overlap around the contour of the shoulders, and are interconnected by means of multiple straps. Examples of such prior art shoulder pads are disclosed in Morgan U.S. Pat. No. 2,953,789, Bennett U.S. Pat. No. 3,127,614 and Mitchell U.S. Pat. No. 3,740,763.

Which such prior art shoulder pads are capable of protecting the joints of the shoulder region, the pad designs are not without shortcomings. For example, while the shoulder pads disclosed in Morgan U.S. Pat. No. 2,953,789 do provide a protective cover around both the acromioclavicular and glenohumeral joints, this shoulder pad is formed from multiple pads interconnected by means of a relatively rigid cantilever structure. Hence, the flexibility of these shoulder pads is limited, which is particularly disadvantageous in a contact sport such as hockey, where a great deal of omni-directional arm motion is required. Similarly, both the Bennett U.S. Pat. No. 3,127,614 and the Mitchell U.S. Pat. No. 3,740,763 disclose shoulder pads formed from a plurality of arcuate members which are interconnected by means of double or multiple strap joints. Consequently, omni-directional movement of the arm is impaired.

Still another shortcoming of prior art shoulder pads is the bulk and weight of the shoulder-protecting structural components they employ. Bulky and weighty pad components not only impair omni-directional movement of the shoulder, but also reduce both the speed and the agility of the athlete. This can be a substantial disadvantage in competitive sporting events involving professional athletes, where even a small diminishment in the speed and agility of the players can result in defeat.

Still another shortcoming associated with many other prior art shoulder pad designs is the lack of any special means to protect the relatively delicate acromioclavicular and glenohumeral joint. The acromioclavicular joint includes the upper region of the shoulder where the end of the collar bone, or clavical, joins with the top portion of the shoulder blade, or scapula. It is the most easily damaged of all the joint in the shoulder region, since the clavical is a bone having a relatively small cross section near its end, and since there is relatively little musclature surrounding the region where the terminus of the clavical engages the top of the scapula. While most prior art shoulder pads afford some amount of protective coverage over the acromioclavicular joint, many do not concentrate structural protection in this region, where it is needed most.

Clearly, there is a need for improved shoulder pads which affords a maximum amount of protection to the acromioclavicular joint without imposing any significant restraint on the arm movement of the wearer. Ideally, such a shoulder pad should include a minimal amount of bulk and weight, so that the wearer maintains his speed and agility out on the playing field. Finally, it would be desirable if such a shoulder pad provided protection to the clavical, glenohumeral joint, and the scapula by means of a lightweight and relatively inexpensive structure which was capable of conforming to a variety of individual physiognomies.

DISCLOSURE OF THE INVENTION

It is a primary object of the invention to provide an improved shoulder pad for protecting the acromioclavicular joint, the glenohumeral joint, the clavical and the scapula by means of a novel array of lightweight shoulder pad components which do not impair the arm movements of the wearer.

Another object of the invention is to provide a lightweight and non-bulky shoulder pad which provides a maximum amount of shock protection in the region of the relatively delicate acromioclavicular joint.

It is further object of the invention to provide a shoulder pad which is confortable to a large variety of individual physiognomies, and whose shoulder-engaging surfaces are coated with an anti-slippage sheet material, such as foamed neoprene.

It is still another object of the present invention to provide a shoulder pad having a saddle member whose inner, shoulder engaging surface includes a shock absorbing assembly which includes a resilient, ring-shaped pad for seating over and conforming to the region surrounding the acromioclavicular joint.

Another object of the invention is to provide an improved shoulder pad having a cup member which is flexibly connected to the saddle member for overlapping the acromioclavicular joint and covering the glenohumeral joint, and for further defining a shock-absorbing air space between these joints and the interior surface of the cup.

It is still a further object of the invention to provide an elongated upper arm pad which is connected to the edge of the saddle member by means of a universally-movable, hinge type joint for both protecting the upper arm, and for assisting the saddle member and spacing the shock-absorbing cup away from the shoulder region.

Another object of the invention is to provide an improved shoulder pad wherein the shock absorbing assembly includes a sheet of anti-slippage sheet material adhered over the ring-shaped pad for defining shock absorbing air spaces both in and around the pad, and for securely seating the shock absorbing assembly of the saddle member over the acromioclavicular joint.

Finally, it is an object of the invention to provide a set of shoulder pads formed from a relatively simple arrangement of shock absorbing components, each of which is fabricated from an easily-washable material.

These and other objects are accomplished by an improved shoulder pad brace which generally comprises a harness assembly which circumscribes the chest of the wearer, and first and second shoulder pads, each of which includes a saddle member for overlying and protecting the upper regions of each shoulder. The inner, shoulder engaging side of each of the saddle members preferably includes a resilient, shock absorbing assembly. This assembly in turn includes a resilient, ring-shaped pad which seats over and conforms to the acromioclavicular joint. This ring-shaped pad may be formed from a resilient plastic foam, or from a cushion filled with a fluid such as air. This ring shaped pad does not necessarily have to be strictly ring-shaped, so long as it seats over the acromioclavicular joint when the improved shoulder pad is worn by an athelete.

Additionally, a sheet of anti-slippage material, which may be foamed neoprene, is adhered over the ring-shaped pad in order to maintain a proper seating engagement between the shock absorbing assembly and the acromioclavicular joint despite any mechanical shock which the shoulder pad may experience in the course of an athletic event. In addition to providing an anti-slip function, the sheet material which overlies the ring-shaped pad defines an air space both in the center of the pad, and the region circumscribing it which enhances the function of the pad in effectively absorbing mechanical shock.

Each of the improved shoulder pads may also include a cup member flexibly mounted over the saddle member for further protecting the acromioclavicular joint, and for also affording protection to the glenohumeral joint. This cup member may include an anterior portion which covers a portion of the clavical leading to the acromioclavicular joint, as well as a posterior portion which substantially covers the scapula of the wearer.

Finally, each of the shoulder pads may include an upper arm pad which is flexibly mounted onto the edge of the saddle member by means of a single hinge joint in order to afford a maximum amount of free arm motion to the wearer. This upper arm member is preferably elongated, and includes a tapered end portion which is riveted onto the edge of its respective saddle member in order to form the aforementioned universal hinge joint. Both the saddle member and the upper arm pad of each shoulder pad operate to space their respective cup members away from the shoulder region in order to form a shock-absorbing air space between the inner surface of the cup, and this shoulder region.

In the preferred embodiment, the saddle member, shock absorbing assembly, upper arm and cup member are formed from non-absorbent plastic foams and sheet materials in order to provide an effective but light-weight shock-absorbing shoulder pad which is easily washable. However, the invention may also be implemented by the use of equivalent shock-absorbing materials, such as fluid filled cushions.

BEST MODE FOR CARRYING OUT THE INVENTION

Figure 1:
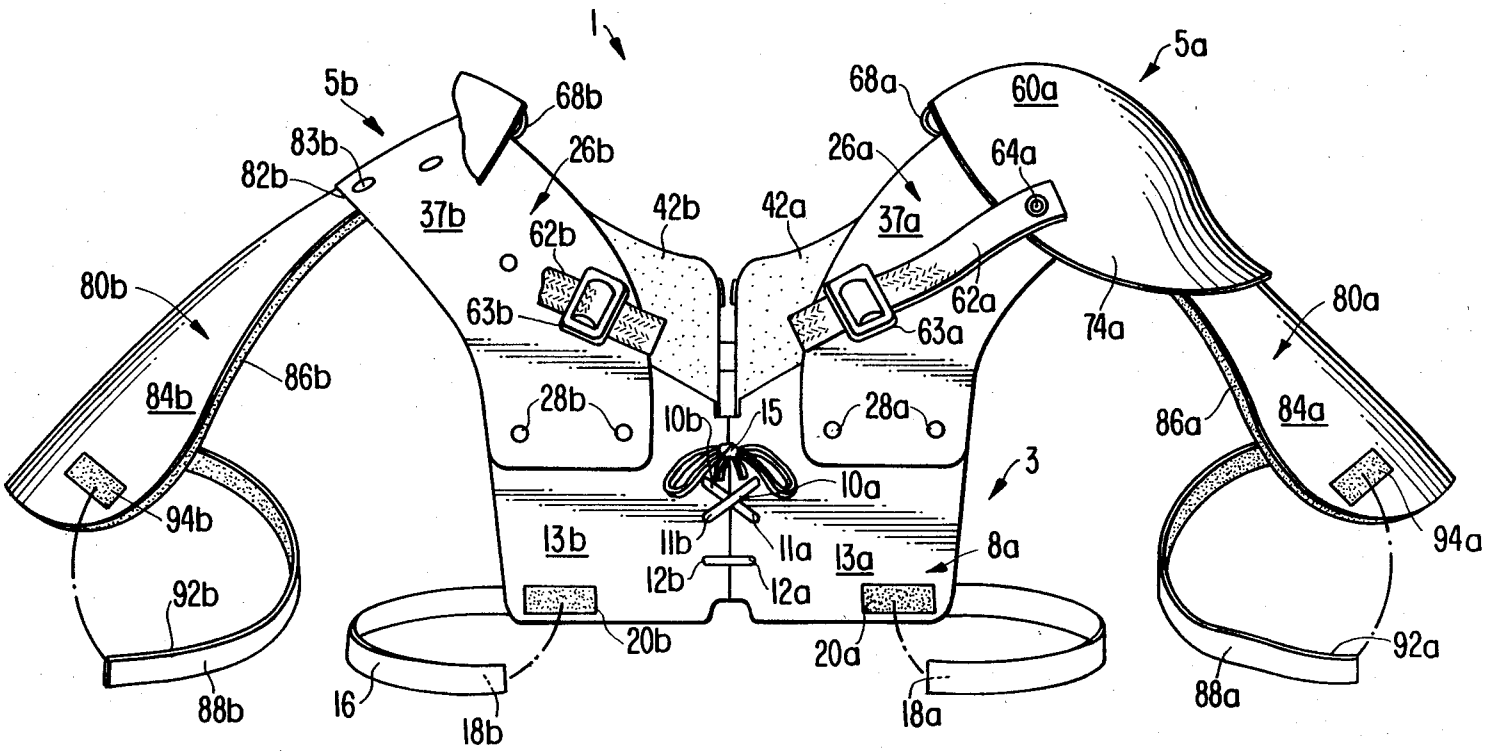
FIG. 1 is a front view of the shoulder pad brace of the invention with the right cup member broken away in order to expose the interconnection between the upper arm pad and saddle member.
Figure 2:
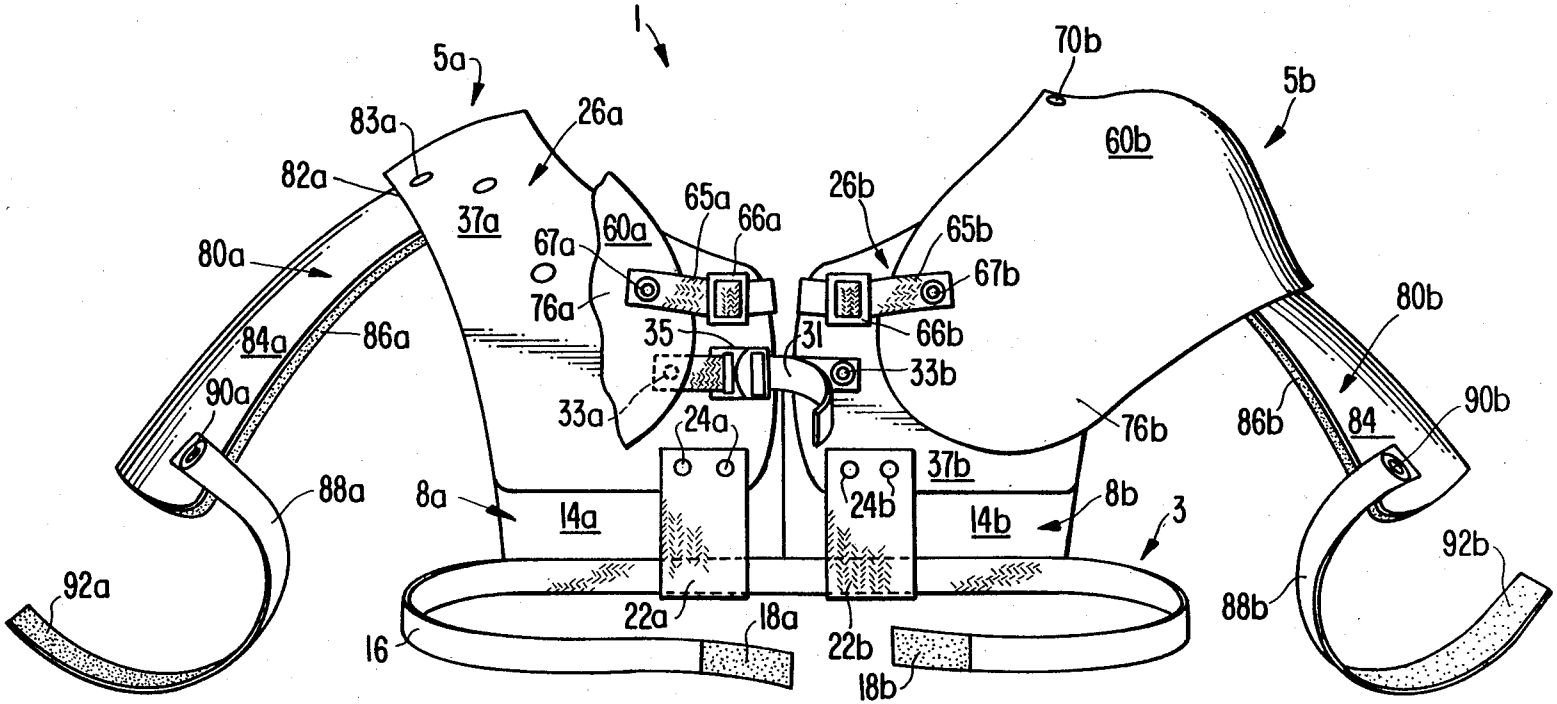
FIG. 2 is a back view of the shoulder pad brace of the invention, again shown with the left cup member broken away.

With reference now to FIGS. 1 and 2, wherein like components are designated by like numerals throughout all the several figures, the shoulder pad brace 1 of the invention generally includes a harness assembly 3 which circumscribes the chest of the wearer having right and left shoulder pads 5*a*, 5*b* mounted thereon.

The harness assembly 3 generally includes right and left breast plates 8*a* and 8*b* which cover the chest of the wearer. Along the inner sides of each of the breast plates 8*a* and 8*b* are a plurality of holes 10*a*, 11*a*, 12*a* and 10*b*, 11*b* and 12*b* as shown. These holes receive a conventional nylon lace 15 which may be used to draw the two breast plates 8*a* and 8*b* together in abutting relationship. In addition to interconnecting the breast plates 8*a* and 8*b* in the position shown, the lace 15 also provides a certain amount of adjustability to the shoulder pad brace 1 as a whole which allows the brace 1 to fit a variety of different sized individual physiognomies. In the preferred embodiment, each of the breast plates 8*a* and 8*b* are formed from a flexible, outer layer 13*a*, 13*b* of sheet polyethylene material, approximately 3/32 of an inch thick, and an inner layer 14*a*, 14*b* of foamed polyethylene sheet material approximately ¼ of an inch thick which is adhered onto the inner surface of the smooth outer layers 13*a*, 13*b* of the breast plates 8*a* and 8*b*. Further, in order to minimize the tendency of the inner foam layers 14*a* and 14*b* to absorb the perspiration of the wearer, the outer surfaces of each of the inner foam layers 14*a* and and 14*b* are preferably glazed to form a thin, water impermeable surface over the small, interconnected cells within the foam layer.

In addition to the breast plates 8*a* and 8*b*, the harness assembly 3 further includes an elastic strap 16 which circumscribes the lower chest region of the wearer, and whose ends include Velcro® pads 18*a* and 18*b* which are detachably connected to co-extensive Velcro pads 20*a* and 20*b* located on the lower right and left corners of the breast plates 8*a* and 8*b*, respectively. As is best seen with respect to FIG. 2, elastic strap 16 is secured onto the lower, rear portions of each of the shoulder pads 5*a* and 5*b* by means of a pair of nylon hinge straps 22*a* and 22*b*. The hinge straps 22*a* and 22*b* are preferably stitched onto the elastic strap 16 at their lower ends, and attached to their respective shoulder pads 5*a* and 5*b* by means of rivets 24*a* and 24*b* as shown.

Finally, the harness assembly 3 includes a rear adjustment strap 31 which is connected across the rear portions of each of the right and left shoulder pads 5*a* and 5*b* by means of rivets 33*a* and 33*b* as shown. The rear adjustment strap 31 includes a buckle 35 for adjusting the distance between the side, back portions of each of the shoulder pads 5*a* and 5*b*. It should be noted that rear adjustment strap 31 compliments the function of front lace 15 in providing a shoulder pad brace 1 which is confortable to a variety of different physiognomies.

Figure 3:
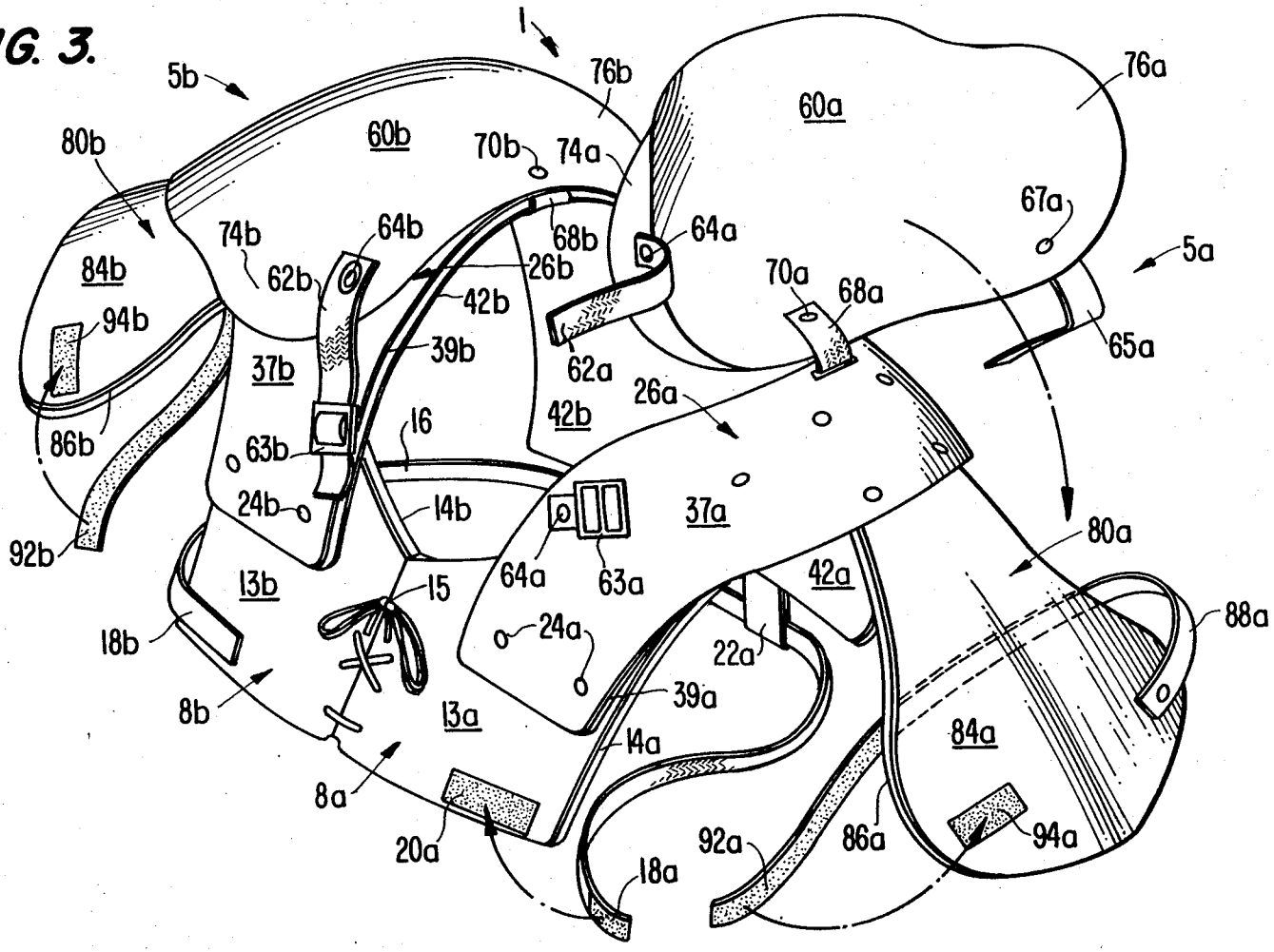
FIG. 3 is an oblique, perspective view of the shoulder brace of the invention, shown with the left cup member pivoted away from its respective saddle member and upper arm pad.
Figure 4:
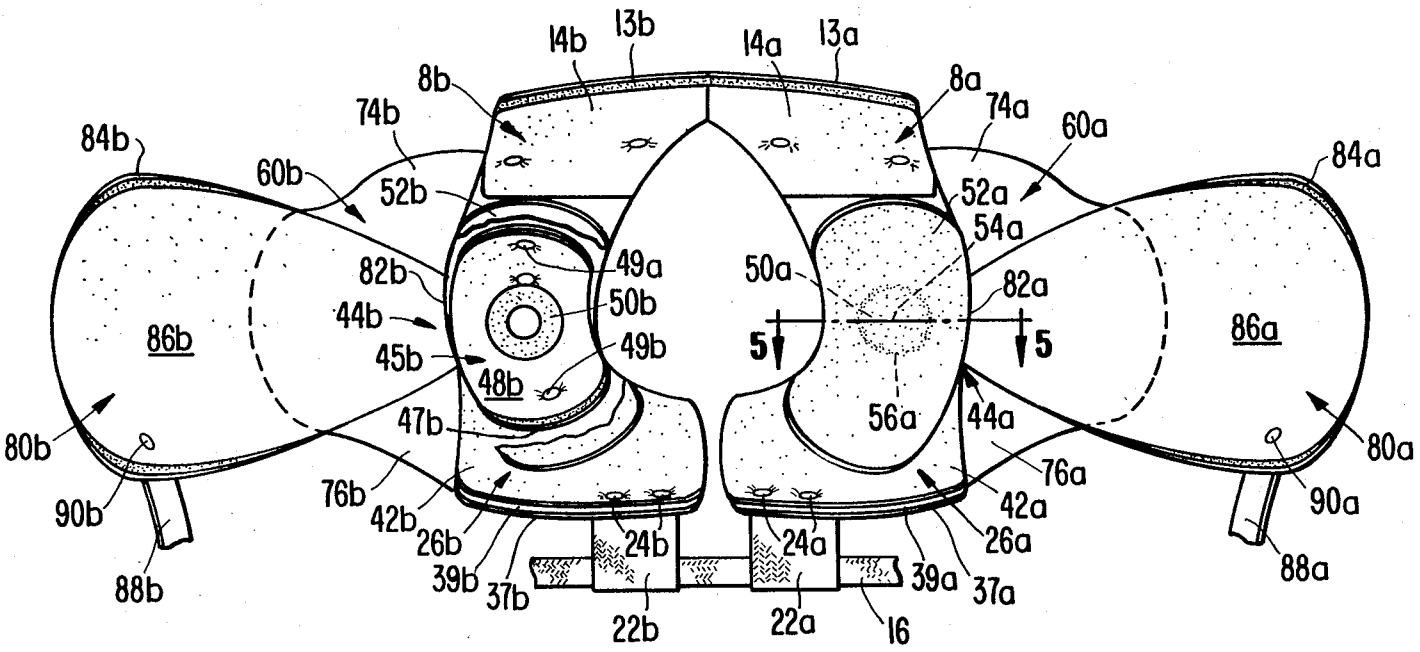
FIG. 4 is bottom view of the shoulder pad brace of the invention, shown with the right, outer layer of anti-slippage neoprene foam broken away to expose the ring-shaped pad of the shock absorbing assembly within the saddle member.

Turning now to FIGS. 3 and 4, each of the shoulder pads 5*a* and 5*b* generally includes a J-shaped saddle member 26*a* and 26*b* for covering the upper portion of the shoulder, and a cup member 60*a* and 60*b* which overlaps the saddle members 26*a* and 26*b* and extends over the lower part of the shoulder, and an upper arm pad 80*a* and 80*b* for protecting the upper arm of the wearer.

Each of the saddle members 26a and 26b has a profile like an inverted "J" when viewed from the side. The long stem of the inverted "J" shape that each of these members 26a and 26b form is connected to the upper portion of each of the breast plates 8a and 8b by means of rivets 28a and 28b as shown, while the short stem extends down from over the scapula of the wearer, and is connected to the previously described nylon hinge members 22a and 22b by means of the rivets 24a and 24b. Like the previously described breast plates 8a and 8b, each of the saddle members 26a and 26b includes an outer layer of bendable polyethylene 37a and 37b, and an inner layer 39a and 39b of polyethylene foam which has been glazed on its exterior surface in order to minimize absorption of perspiration. However, the outer layer 37a and 37b is formed from a stronger and more rigid polyethylene sheet material which is approximately 5/32 inch in thickness since each of the saddle members 26a and 26b overlies the relatively delicate acromioclavicular joint. Additionally, in order to minimize slippage between the saddle members 26a and 26b and the wearer as a result of the shock and stress received during a contact sport, a first layer of flexible, non-slip material 42a, 42b, which is preferably foamed neoprene approximately 3/32 inch in thickness, is adhered over the glazed outer surface of each of the inner foam layers 39a and 39b.

Figure 5:
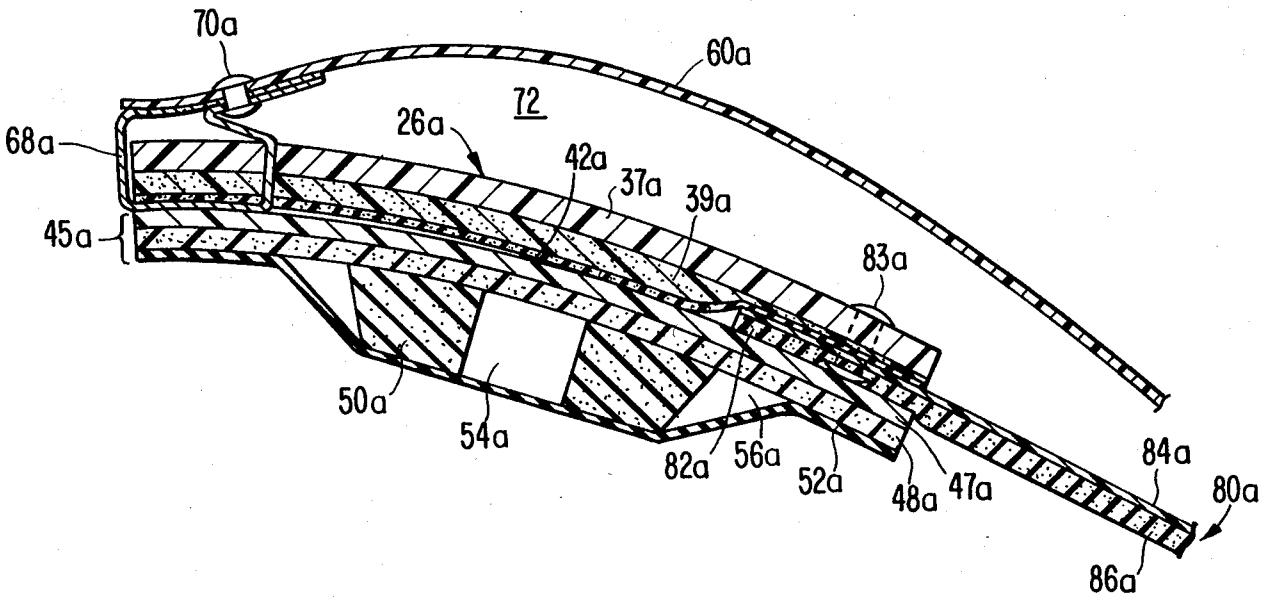
FIG. 5 is cross sectional view of the left shoulder pad of the invention as seen through the line 5—5.

With specific reference now to FIGS. 4 and 5, each of the saddle members 26a and 26b includes a shock absorption assembly 44a and 44b mounted over its inner shoulder-engaging surface for protecting the acromioclavicular joint. In order to avoid prolixity, the following description will be confined to shock absorption assembly 44b, it being understood that the shock absorption assembly 44a of saddle member 26a includes the same components arranged in the same configuration. Shock absorption assembly 44b includes a rounded shoulder seating member 45b. Member 45b includes an outer layer 47b formed from the same relatively thick polyethylene sheet material which forms the outer surface of the saddle member 26b, as well an inner foam layer 48b formed from the same glazed, polyethylene foam which forms the inner layer of the saddle member 26b. The shoulder seating member 45b is firmly affixed within the inner elbow of the inverted "J" shaped saddle member 26b by means of rivets 49a and 49b. Centrally disposed within the shoulder seating member 45b and adhered thereto is a ring or doughnut shaped pad 50b. In the preferred embodiment, pad 50b is formed from a "T" foam having a compressability which is substantially less than the compressability of the polyethylene foam forming the inner foam layer 48b of the shoulder seating member 45b. However, pad 50b may just as easily be formed from a fluid filled member, such as an air cushion.

Completing both shock assemblies 44a and 44b is a second layer of flexible, anti-slip sheet material 52a, 52b which is preferably glued over the ring-shaped pads 50a, 50b, and the shoulder seating members 45a, 45b. Like layers 42a and 42b, layers 52a and 52b are preferably formed from foamed neoprene approximately 3/32 inch in thickness. As may best be seen in FIG. 5, the second layer of non-slip materials 52a and 52b forms two shock absorbing air spaces in the area around each of the ring-shaped pads 50a, 50b, including a centrally located air space 54a and 54b in the center of each pad, as well as circumferrential air spaces 56a, 56b located around each pad. While each of the components of the shock absorption assembly has been described in terms of plastic foams and sheet materials, it should be noted that an equivalent structure which falls within the scope of this invention may be formed from an array of fluid filled members, such as air cushions. Also, the pads 50a and 50b need not be strictly ring-shaped, so long as it seats over and conforms to the acromioclavicular joint when the improved shoulder pad is worn.

With reference now to FIGS. 3 and 5, each of the shoulder pads 5a and 5b further includes a cup member 60a and 60b which is flexibly mounted over each of the saddle members 26a and 26b in overlapping relationship. More specifically, each of the cup members 60a and 60b is mounted over its respective saddle member 26a, 26b by means of a front strap 62a, 62b, a rear strap 65a, 65b and a nylon strap hinge 68a and 68b. As is best seen with respect to FIG. 5, each of the nylon strap hinges 68a and 68b are riveted onto their cups 60a and 60b by means of a rivet 70a, 70b, as shown. The front straps 62a, 62b and the rear straps 65a, 65b each include a buckle 63a, 63b and 66a, 66b for adjusting the degree to which the cup 60a and 60b are drawn over the posterior or anterior portion of the shoulder region. Both of the front and the rear straps 62a, 62b and 65a, 65b are connected on one side to their respective saddle member 26a and 26b by means of rivets 64a, 64b and 67a, 67b. Each of the cup members 60a, 60b, overlaps the section of its respective saddle member 26a and 26b which overlies the acromioclavicular joint, and further extends over the rest of the glenohumeral joint (not shown). The proximal ends of each of the cup members (closest to the neck of the wearer) bow out over the acromioclavicular-joint covering portion of the saddle members 26a and 26b, and define a shock absorbing air space 72 thereover as may best be seen in FIG. 5. Additionally, each of the cup members 60a, 60b includes an anterior portion 74a, 74b for covering the front of the glenohumeral joint, as well as an extended posterior portion 76a, 76b for covering the scapulae of the wearer. In the preferred embodiment, each of the cup members 60a, 60b is formed from a strong, lightweight and shock absorbing plastic material, such as polyprobutylene or polypropylene.

Finally, each of the shoulder pads 5a, 5b includes an upper arm pad 80a and 80b. Each of these upper arm pads 80a, 80b is elongated, and includes a tapered end, 82a, 82b for forming an omni-directional hinge joint between its respective pad, and the distal edges of the saddle members 26a and 26b. As may best be seen with reference to FIG. 5, each of these tapered ends 82a, 82b is sandwiched between the outer layer of foam neoprene 42a, 42b of the saddle members 26a, 26b, and the upper, polyethylene layer 47a, 47b of the shoulder seating member 45a, 45b. The hinged joint is completed by means of rivets 83a, 83b which secure the tapered ends 82a, 82b of each of the upper arm pads 80a, 80b to their respective saddle members 26a, 26b.

In the preferred embodiment, each of the upper arm pads 80a, 80b includes a flexible outer layer 84a, 84b which is preferably formed from polyethylene sheet material approximately 3/32 of an inch thick, as well as an inner layer of polyethylene foam 86a, 86b which is approximately ¼ inch thick. As was the case with the saddle members 26a, 26b, the inner layer of foam 86a, 86b is preferably adhered onto the inner surface of the polyethylene outer layers 84a, 84b by means of a glue. Additionally, the outer surface of the inner layer of foam 86a, 86b of each of the pads 80a, 80b is glazed in order to minimize the amount of perspiration that the foam layers 86*a* and 86*b* absorb. In order to maximize the degree to which the upper arm pads 80*a*, 80*b* conform to the movements of the upper arms of the wearer of the shoulder pad brace 1, each of the upper arm pads 80*a* and 80*b* includes an upper arm strap 80*a*, 80*b* secured thereto by means of a rivet 90*a*, 90*b*. Each of the ends of the upper arm straps 88*a*, 88*b* include a Velcro pad 92*a*, 92*b* which is detachably connectable to a coextensive Velcro pad 94*a*, 94*b* located on the lower portion of each of the pads 80*a*, 80*b*.

Industrial Applicability

The improved shoulder pad brace 1 of the invention may be used to protect both the acromioclavicular and glenohumeral joints of an athelete (not shown) engaging in a contact sport such as hockey or football. The brace is initially placed onto the athelete by detaching the Velcro pads 18*a* and 18*b* of the straps 16 of the harness assembly 3 from the breast plates 8*a* and 8*b*, and the straps 88*a* and 88*b* of each of the upper arm pads 80*a* and 80*b* from the Velcro pads 94*a* and 94*b*. The shoulder pad brace 1 is then slid over the head of the athlete, so that the shock absorbing assemblies 44*a* and 44*b* are squarely seated over the acromioclavicular joints of the athelete. The straps 16, 88*a*, and 88*b* are then attached. If necessary, both the breast plate lace 15 and the rear adjustment strap 31 are adjusted so that the harness assembly 3 firmly circumscribes the chest of the athelete without impairing inhalation. Next, the cup members 16*a* and 16*b* are secured over the shoulder regions of the athlete in proper orientation by means of front and rear straps 62*a*, 62*b* and 65*a*, 65*b*.

When the shoulder brace 1 of the invention is thus properly secured over the shoulders of an athlete, it is apparent from FIGS. 1 and 5 that the shoulder region in general, and the acromioclavicular joint in particular, are well protected. Specifically, the distal ends of the cup members 60*a* and 60*b* and the upper arm pads 80*a* and 80*b* completely wrap around the sides of each of the shoulder regions of the athelete, while the interior and exterior portions 74*a*, 74*b* and 76*a*, 76*b* of each of the cups 60*a* and 60*b* fully cover and protect the front of the glenohumeral joint and a large portion of the clavical, as well as the upper portion of the scapulae, respectively. Finally, from FIG. 5 it is clear that each of the delicate acromioclavicular joints is protected by the resilient, ring-shaped pads 50*a* and 50*b*, the air spaces 54*a*, 54*b* and 56*a*, 56*b* centrally and circumferentially disposed around the pads 50*a* and 50*b*, two layers of rigid polyethylene foam 26*a*, 47*a* and 26*b* 47*b*, two layers polyethylene foam 39*a*, 48*a* and 39*b*, 48*b*, the cup members, 60*a* and 60*b*, and finally the air spaces 72*a*, 72*b* defined between the cup members 60*a*, 60*b* and upper surfaces of the saddle members 26*a* and 26*b*.

We claim:

1. An improved shoulder pad brace for protecting the shoulder regions of a user from shock, comprising:

a. a harness assembly for overlying the user's chest, said harness assembly including first and second breast sections of impact resistant plastic;

b. first and second saddle members of impact resistant plastic, each of which is connected to the harness assembly, for overlying and protecting the upper region of each shoulder, wherein the shoulder-engaging side of each saddle member includes a resilient shock absorbing assembly, and c. first and second cup members flexibly connected to said first and second saddle members, respectively, and mounted in partially overlapping relationship over said first and second saddle members, respectively, for overlying and protecting both the acromioclavicular and glenohumeral joints of each shoulder, said shock absorbing assembly including a shock absorbing cushion means positioned over the region surrounding the acromioclavicular joint of a user, said shock absorbing cushion means including a resilient pad means secured to each said saddle member and shock dissipating means secured to said resilient pad means and extending outwardly therefrom, said shock dissipating means defining at least one air space, the compressibility of said shock dissipating means differing from the compressibility of said resilient pad means.

2. An improved set of shoulder pads and defined in claim 1, wherein each of the first and second saddle members is formed from sheet material which is generally curved in a J shape, wherein the longer leg of each saddle member extends over the clavicle, and the shorter leg extends over the upper portion of the scapula.

3. An improved set of shoulder pads as defined in claim 1, further including first and second upper arm pads connected underneath the ends of said first and second saddle members, respectively, for both assisting the saddle members in defining a shock-absorbing air space, and for protecting the upper portion of each arm.

4. An improved set of shoulder pads as defined in claim 1, wherein each of said cup members includes an anterior portion for protecting the front of the glenohumeral joint, and a posterior portion for protecting the scapula.

5. The improved shoulder pad brace of claim 1 wherein said shock dissipating means includes a ring shaped pad secured to said resilient pad means and overlying the region surrounding the acromioclavicular joint of the user.

6. The improved shoulder pad brace of claim 5 wherein the compressibility of said ring shaped pad is less than that of said resilient pad means.

7. The improved shoulder pad defined in claim 5, wherein said saddle assembly includes at least one layer of resilient, anti-slippage sheet material adhered to the inside surface of said saddle member over said ring shaped pad both to define shock absorbing air spaces between the sheet material and the interior of the saddle member, and to provide an anti-slip surface between the saddle assembly and the region surrounding the acromioclavicular joint.

8. The improved shoulder pad defined in claim 5, wherein said cup member includes an anterior portion for completely covering the front of the glenohumeral joint, and a posterior portion for protecting the scapula.

9. The improved shoulder pad defined in claim 8, wherein said cup member is integrally formed from an impact resistant plastic.

10. The improved shoulder pad defined in claim 5, wherein said saddle member spaces the inner surface of the overlying cup away from the glenohumeral joint in order to define a shock-absorbing air space between said joint and the interior of said cup.

11. The improved shoulder pad defined in claim 10, further including an upper arm pad which is connected underneath the end of the saddle member for both assiting the saddle member in defining said shock-absorbing air space, and for protecting the upper portion of the arm.

12. The improved shoulder pad defined in claim 11, wherein said upper arm pad is connected underneath the end of the cup by a single, univerally flexible hinge means in order to afford a maximum degree of relative movement between said upper arm pad and said saddle member.

13. The improved shoulder pad defined in claim 12, wherein said upper arm pad includes means for detachably connecting said pad to an upper arm.

14. An improved set shoulder pad brace for protecting the shoulder regions from mechanical shock, comprising;

(a) an adjustable harness assembly detachably mountable around the chest region;

(b) first and second saddle members, each of which is connected at either end of the harness assembly, for overlying and protecting the upper region of each shoulder, wherein the shoulder-engaging side of each has a shock absorbing assembly which includes a resilient, ring shaped pad for seating over and conforming to the region surrounding the acromioclavicular joint, and a layer of resilient, anti-slippage sheet material secured over said ring shaped pad for defining a shock absorbing air space between said pad and the portion of said shoulder engaging side of each said saddle members, and for providing an anti-slip surface between each of the saddle members and the region surrounding the acromioclavicular joint;

(c) first and second cup members flexibly mounted in partially overlapping relationship over said first and second saddle members for overlying and protecting both the acromioclavicular and glenohumeral joints of each shoulder, wherein each cup member includes an anterior portion which overlies the clavicle, and a posterior portion which overlies the scapula.

15. An improved set of shoulder pads as defined in claim 14, wherein said shock absorbing assembly of each saddle member further includes a resilient layer of sheet material between the bottom surface of said ring shaped pad and the shoulder engaging surface of said saddle member.

16. An improved set of shoulder pads as defined in claim 15, wherein said bottom most resilient layer of sheet material is less easily compressable than said ring shaped pad.

17. An improved set of shoulder pads as defined in claim 16, further including first and second elongated upper arm pads, each of which includes a tapered portion at one end which is connected to one of said saddle members between its bottom most resilient layer of sheet material shoulder engaging surface for providing a universal hinge joint between each of said arm pads and its respective saddle member, wherein said arm pads define a shock absorbing air space between said cup members and said shoulder s by spacing said cup members away from their respective shoulders while protecting the upper portion of each arm.

18. An improved set of shoulder pads as defined in claim 14, wherein the entire shoulder engaging surface of each saddle member is covered with a layer of anti-slip material.

19. An improved set of shoulder pads as defined in claim 14, wherein each cup member is integrally formed from an impact resistant plastic.

20. An improved shoulder pad brace for protecting the shoulder regions of a user from shock, comprising first and second breast sections adapted to overlie the breast of a user, said breast sections each having an upper end and a lower end, first and second curved saddle members extending from the upper ends of said first and second breast sections, respectively, and being adapted to curve over the shoulders of a user on either side of the user's neck, said first and second curved saddle members each having a back section which terminates at a lower end and is adapted to overlie at least a portion of the back of a user, first and second cup members flexibly secured to said first and second curved saddle members, respectively, and each having a first end section which overlies a portion of the respective curved saddle member to which said cup member is attached, a second end section spaced from said first end section, an anterior edge and a posterior edge extending in spaced relationship between said first and second end sections, each said cup member curving outwardly from said first end section toward said second end section and curving outwardly from said posterior edge and said anterior edge to form an anterior portion which is adapted to overlie the clavicle and a posterior portion adapted to overlie the scapula of a user, first and second curved upper arm protection means extending outwardly from beneath the second end section of said first and second cup members, and means for flexibly connecting said first and second curved upper arm protection means to said first and second curved saddle members.

21. The improved shoulder pad brace of claim 20 wherein each of said first and second cup members is connected to a respective first or second curved saddle member by at least two spaced flexible straps extending between the first end section of the cup member and the curved saddle member.

22. The improved shoulder pad brace of claim 20 wherein said first and second arm protection means are outwardly curved in the direction of curvature of said first and second cup members, each of said first and second arm protection means being provided with a strap to secure the arm protection means to the upper arm of a user.

23. The improved shoulder pad brace of claim 20 wherein said first and second cup members and first and second arm protection means combine to provide an arm protection assembly which extends from the shoulder down over a substantial portion of the upper arm of a user.

24. The improved shoulder pad brace of claim 20 which includes a connector assembly means for connecting the lower end of a back section of said first and second curved saddle members to said first and second breast sections, said connector assembly means including at least one flexible hinge strap means extending outwardly beyond the lower end of each back section of said first and second curved saddle members, and elongated strap means supported by said flexible hinge strap means and adapted to be secured to said first and second breast sections.

25. The improved shoulder pad brace of claim 20 wherein padding means are secured to underlie said breast plate sections, said first and second curved saddle members and said first and second arm protection means.

26. The improved shoulder pad brace of claim 25 wherein said breast plate sections, first and second curved saddle members, first and second cup members and first and second curved upper arm protection means are formed from impact resistant plastic.

27. The improved shoulder pad brace of claim 26 wherein said first and second cup members and first and second arm protection means combine to provide an arm protection assembly which extends from the shoulder down over a substantial portion of the upper arm of a user, each of said first and second cup members being connected to a respective first or second curved saddle member by at least two spaced flexible straps extending between the first end section of the cup member and the curved saddle member to which the cup member is attached, each of said first and second arm protection means being provided with a strap to secure the arm protection means to the upper arm of a user, and said first and second curved saddle members including a connector assembly means for connecting the lower end of the back section thereof to said first and second breast sections, said connector assembly means including at least one flexible hinge strap means extending outwardly beyond the lower end of each back section of said first and second curved saddle members, and elongated strap means supported by said flexible hinge strap means and adapted to be secured to said first and second breast sections.

* * * * *